United States Patent [19]

Westenhofer et al.

[11] 4,286,667

[45] Sep. 1, 1981

[54] FLOW CONTROL AND FIRE DETECTION APPARATUS

[75] Inventors: Donald G. Westenhofer, Brookfield, Conn.; Gershon Meckler, Bethesda, Md.

[73] Assignee: Gershon Meckler Associates, P.C., Washington, D.C.

[21] Appl. No.: 15,619

[22] Filed: Feb. 27, 1979 (Under 37 CFR 1.47)

[51] Int. Cl.[3] ..... A62C 35/00

[52] U.S. Cl. ..... 169/16; 62/331

[58] Field of Search ..... 169/16, 19, 23, 5, 22, 169/20; 62/331, 259

[56] References Cited

U.S. PATENT DOCUMENTS

| | | | |
|---|---|---|---|
| 2,891,625 | 6/1959 | Hube | 169/23 |
| 3,918,525 | 11/1975 | Meckler | 169/23 |
| 3,939,914 | 2/1976 | Carroll | 169/16 |
| 4,033,740 | 7/1977 | Meckler | 169/19 |
| 4,051,467 | 9/1977 | Galvin | 169/23 |

FOREIGN PATENT DOCUMENTS

| | | | |
|---|---|---|---|
| 2608293 | 9/1977 | Fed. Rep. of Germany | 169/23 |

*Primary Examiner*—Robert J. Spar
*Assistant Examiner*—Kenneth Noland
*Attorney, Agent, or Firm*—John C. Purdue

[57] ABSTRACT

Flow control and fire detection and location apparatus is disclosed. The apparatus is used with a system which circulates heated or cooled water for use in connection with the heating and air conditioning system of a building and to sprinker heads. The apparatus comprises a short length of tubing or pipe connected downstream of a sprinkler connection to provide a bypass for flow of heated or cooled water around a segment of the return line from heating or cooling apparatus to a standpipe through which the water is returned to an equipment room. There are check valves to prevent flow of water through the bypass toward the heating or cooling apparatus, and to prevent water flow in the bypassed segment from the heating or cooling apparatus toward the standpipe. There is also a flow sensor in the bypassed segment. In normal operation, water from the heating or cooling apparatus flows through the bypass line to the standpipe and back to the equipment room for heating or cooling and recirculation. When one of the sprinkler heads is fused by a fire, flow therethrough is detected, triggers an alarm and converts the system to "fire mode". Flow through a bypassed segment causes the flow sensor therein to transmit a signal which indicates the location of the fire.

1 Claim, 2 Drawing Figures

FLOW CONTROL AND FIRE DETECTION APPARATUS

BACKGROUND OF THE INVENTION

The use of heated or cooled water for heating or cooling a building and, when required, to serve sprinkler heads for combatting a fire is not new, having been suggested, for example, in U.S. Pat. Nos. 3,918,525, granted Nov. 11, 1975 and 4,033,740, granted July 5, 1977, and in reference cited thereagainst. The earlier of the indicated patents suggests sprinklers connected to the inlet lines for air conditioning apparatus so that flow, when a sprinkler is in operation, is divided between the apparatus and the sprinkler; a flow detecting switch is also disclosed in the line to the sprinkler to enable detection of flow to a sprinkler, and location of the sprinkler involved, if desired.

BRIEF DESCRIPTION OF THE INSTANT INVENTION

The present invention is based upon the discovery of apparatus wherein heated or chilled water used, under normal circumstances, to heat or cool a building is available to sprinkler heads, if required because of a fire within the building, but wherein, in the event of a fire, all of the water required for the sprinkler system is supplied from a standpipe which normally constitutes a return line for the heating or cooling water.

DESCRIPTION OF PREFERRED EMBODIMENTS

Figure 1:
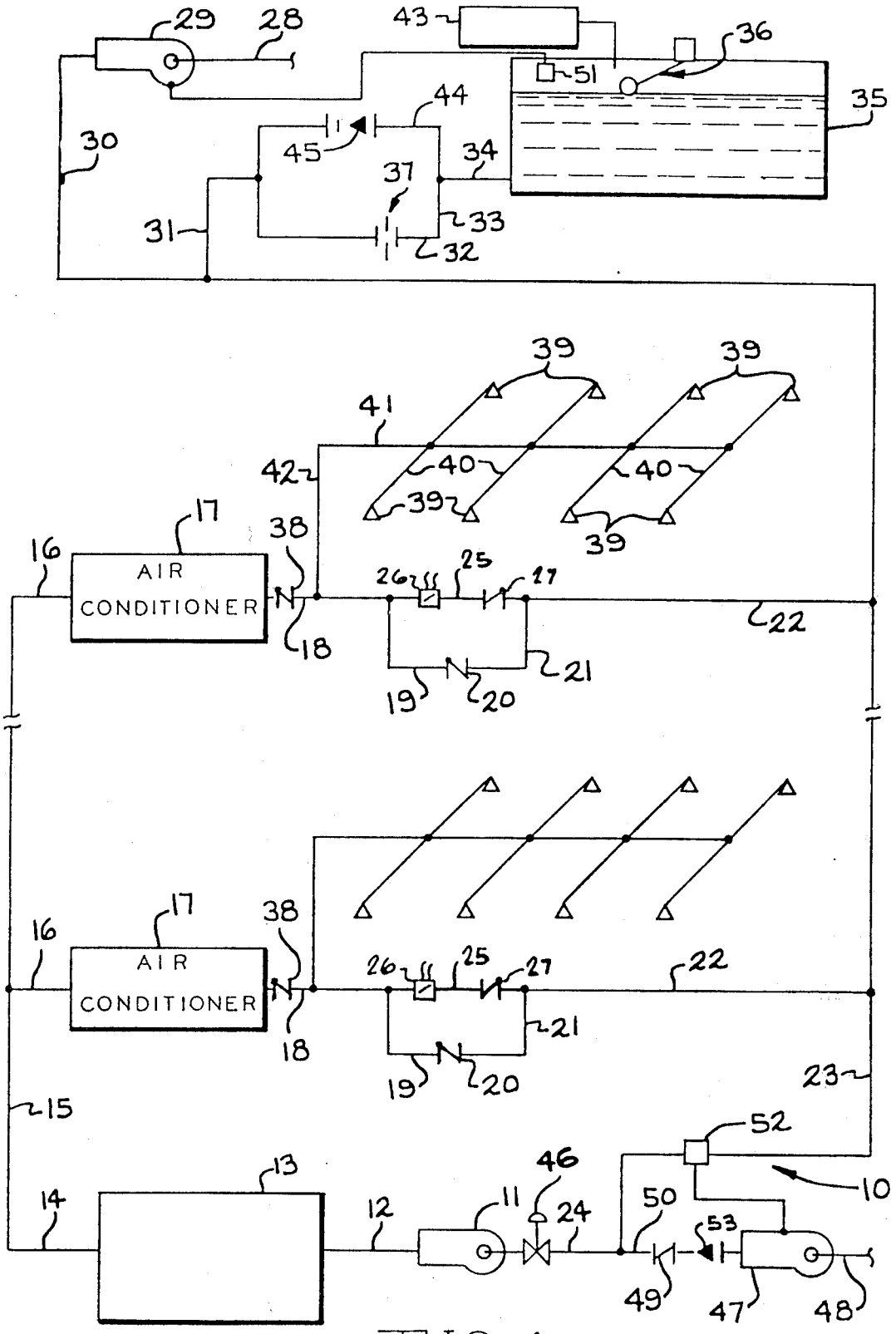
FIG. 1 is a partially schematic diagrammatic view showing apparatus according to the present invention in normal operation.

Referring to FIG. 1 of the drawings, apparatus according to the invention indicated generally at 10 comprises a pump 11 by which water is circulated through a line 12 to a heat transfer device 13, which can be either a heater or a cooler, depending upon requirements, and from thence through a line 14, a riser 15 and lines 16 to air conditioning units 17. The air conditioning units 17 can be of the type to which primary, conditioned air is supplied at a desired rate, and is mixed with fan or otherwise induced room air and wherein the mixture, after heating or cooling, as required, is returned to the room. Under conditions of normal building operation, as illustrated in FIG. 1, water leaves the air conditioning units 17 through lines 18, lines 19, check valves 20, lines 21 and lines 22 from which it flows into a standpipe 23 and downwardly therein to a line 24 connected to the inlet to the pump 11. In this mode of operation, flow of water from the air conditioning units 17 through a line 25 and a flow indicator 26 positioned therein is prevented by a check valve 27.

Makeup water for the apparatus 10 is supplied from a source (not illustrated) through a line 28, and is pumped by a pump 29 through lines 30, 31, 32, 33 and 34 to a storage tank 35. Operation of the pump 29 is controlled by a float controller indicated generally at 36 to maintain a predetermined water level within the tank 35. When the pump 29 is not operating makeup water from the tank 35 flows through the line 34, the line 33, the line 32, a flow restricting orifice 37, and the line 31 to maintain a predetermined pressure on the standpipe 23. The apparatus also includes check valves 38 to prevent, in fire mode, a reverse flow of water through the air conditioning units 17.

Figure 2:
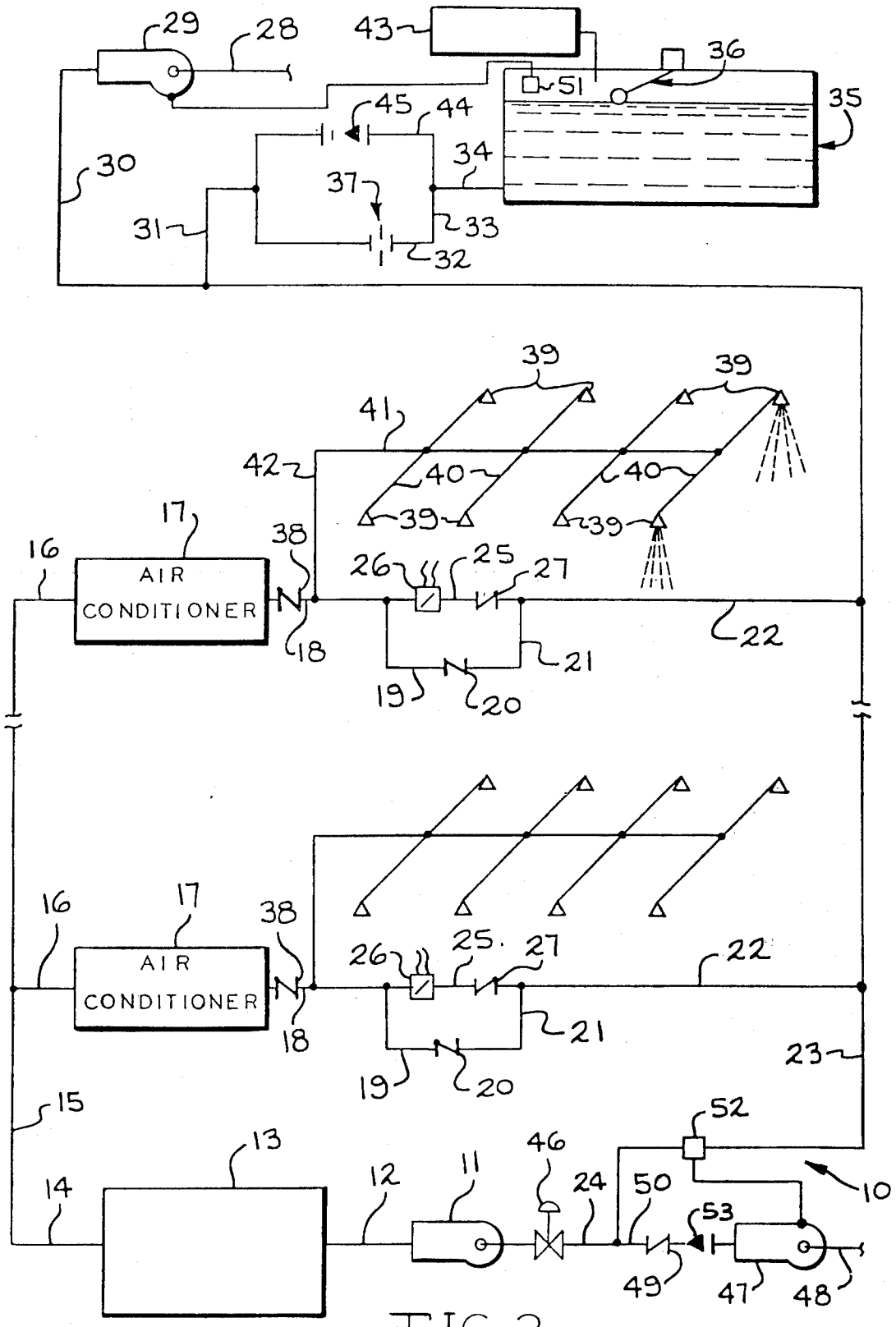
FIG. 2 is a view similar to FIG. 1, but showing the apparatus when operating in fire mode.

Referring to FIG. 2, the apparatus 10 is shown in fire mode with two of several sprinkler heads 39 serving a particular floor of the building discharging water because their seals have been fused by a fire. Water flows to the affected sprinkler heads 39 from supply lines 40 through lines 41 and 42, typically at a rate of about 17 gallons per minute per head. The pump 29 has a capacity less than the discharge rate from one of the sprinkler heads 39, for example, eight gallons per minute, Consequently, a flow of water from even one of the sprinkler heads 39 occurs at a rate greater than the capacity of the pump 29. The pressure within the tank 35 is above the water supply, for example at about 65 pounds per square inch depending upon the height of the building, by an air compressor 43. As a consequence, when water is flowing from one of the sprinkler heads 39, there is also a flow of water from the tank 35 into the standpipe 23. This flow can occur through the lines 34, 33 and 32, the orifice 37 and the line 31. However, the orifice 37 is sized, relative to the pressure maintained within the tank 35, to limit the indicated flow to a rate insufficient to make up the difference between the rate of water discharged from one sprinkler head 39 and the rate at which water is supplied by the pump 29; as a consequence, there is a pressure differential between the line 31 and a line 44 which causes an alarm check valve 45 to trip, generating a signal, which sounds an audible alarm, de-energizes the pump 11, and, if desired, closes a valve 46. When the system pressure sensed by a pressure sensor 52 drops, for example, 35 pounds per inch square, a fire pump 47 is energized thereby. The fire pump 47 pumps makeup water for fire fighting purposes from the City main or other fire water source (not illustrated) through a line 48, to a check valve 49 and a line 50 and then to the standpipe 23. The check valves 38, if used, prevent a reverse flow of water through the air conditioning units 17 so that, in the mode just described, the only flow of water in the system is from the pump 47, through the standpipe 23 and from the fused ones of the sprinkler heads 39. The check valve 20 prevents this flow from occurring through the lines 19 and 21 while the check valve 27 is ineffective to prevent the flow through the line 25 and the flow sensor 26. Such flow causes a signal from the affected one of the sensors 26; this signal is used to indicate the floor where the fire has occurred, or, in the case of a floor served by a plurality of sets of sprinkler heads, the floor and the zone of that floor where the fire has occurred.

The apparatus 10 also includes a pressure sensor 51 in the tank 35 and a pressure sensor 52 in the standpipe 23. Appropriate use of these two pressure sensors, as described below, enables operation of the apparatus 10 in a different manner. As shown, the sensor 51 is operatively connected in controlling relation with the pump 29 and can be set, for example, to energize that pump whenever the sensed pressure is less than 60 pounds per square inch gauge and to de-energize the pump 29 whenever the sensed pressure is greater than 65 pounds per square inch gauge. As previously described, the pump 29 is incapable of pumping at a rate sufficient to make-up for loss through a fused sprinkler head 39. In this mode of operation, the compressor 43, defloat controller 36 and the alarm check valve 45 are not required:

The tank 35 can merely be pressurized by puming water thereinto until air trapped therein reaches the desired pressure. In normal operation, the system pressure measured at the outlet of the pump 47, is greater than the water supply pressure. The pressure sensor 52 is operatively connected to the fire pump 47, and energizes that pump whenever the pump 29 is incapable of maintaining pressure and an excessive pressure drop for example, 30 lbs. per square inch, is sensed by the sensor 52. The flow of water from the fire pump 47 passes through and trips an alarm check valve 53, starting a fire mode sequence; an audible alarm is sounded; the pump 11 is de-energized; and, if desired, the valve 46 is closed.

It will be apparent that various changes and modifications can be made from the apparatus shown in the attached drawings and described in connection therewith without departing from the spirit of the invention as defined in the appended claims.

What we claim is:

1. Apparatus comprising a system for circulating an aqueous heat transfer fluid from an equipment station, into heat transfer relationship with at least one heat transfer unit and through a conduit which returns the fluid back to the equipment station, a plurality of sprinkler heads, and means operatively connecting the sprinkler heads to receive heat transfer fluid from the circulating system, the improvement wherein the connecting means for the sprinkler heads is connected to the circulating system between a heat transfer unit and the return conduit with no heat transfer unit between said connection and the return conduit, means providing parallel flow paths between said connection and the return conduit, a first check valve in one of said parallel flow paths, said check valve being effective to prevent fluid flow from the return conduit toward said connection, a flow sensor and a second check valve in the other of said parallel flow paths, said second check valve being effective to prevent flow from said connection toward the return conduit, makeup means operatively connected to introduce water into the return conduit, means responsive to a changed condition in the circulating system which changed condition indicates that fluid id flowing from the system and effective in response to the changed condition to activate said makeup means to introduce water into the return conduit whereby, when the apparatus is operating normally, the fluid flows from said connection through said first check valve to the return conduit while, when the apparatus is in a fire mode, fluid flows from the return conduit through said second check valve and said flow sensor to said connection, and then from the system, and a signal from the flow sensor can be used to indicate the location of the fluid flow from the system.

* * * * *